United States Patent [19]

Banks, Jr.

[11] 4,123,177

[45] Oct. 31, 1978

[54] TRAY ROCKER DEVICE

[75] Inventor: Neill K. Banks, Jr., Gloucester, Mass.

[73] Assignee: Bomco, Inc., Gloucester, Mass.

[21] Appl. No.: 800,221

[22] Filed: May 25, 1977

[51] Int. Cl.[2] ..... B01F 13/00

[52] U.S. Cl. ..... 336/239

[58] Field of Search ..... 259/73, 74, 55, ; 354/328

[56] References Cited

U.S. PATENT DOCUMENTS

| | | | |
|---|---|---|---|
| 634,639 | 10/1899 | Clarke | 259/73 |
| 734,693 | 7/1903 | Fraley | 259/73 |
| 3,478,666 | 11/1969 | Bishop | 259/73 X |

*Primary Examiner*—Edward J. McCarthy

[57] ABSTRACT

Disclosed herein is a tray rocker device whereby manual agitation of the liquid contents of a tray, such as a photographic developer tray, may be readily performed.

9 Claims, 2 Drawing Figures

TRAY ROCKER DEVICE

FIELD OF THE INVENTION

The present invention relates generally to tray rockers and is more particularly concerned with devices of the type whereby the liquid contents of a tray, such as a photographic print developer or fixer tray, may be manually agitated.

OBJECTS OF THE INVENTION

It is a principal object of the invention to provide a novel tray rocker.

It is another object of the invention to provide an easily fabricated, manually operated tray rocker of simple construction.

It is another object of the invention to provide a manually operated tray rocker having limit stops to mitigate against excessive agitation and spillage of the liquid contents of a tray equipped therewith.

It is another object of the invention to provide a manually operated tray rocker which is readily assembled and removed from a tray to be served thereby.

Other objects and advantages of the present invention will, in part, be obvious and will, in part, appear hereinafter.

SUMMARY OF THE INVENTION

In accordance with the invention, the tray rocker hereof broadly comprises a one-piece structure formed from a sheet-form material and comprising a shallow U-shaped central portion and tray support elements extending substantially horizontally from the end of each leg of said U-shaped portion, said support elements together defining a platform to receive a tray thereon.

THE DRAWING

FIG. 1 hereof is a schematic, diagrammatic top view of a tray rocker in accordance with the invention.

FIG. 2 hereof is a schematic, diagrammatic, partially sectional side view of the tray rocker of FIG. 1 having a tray supported thereon, said rocker and tray being shown in a rocking limit position.

DESCRIPTION OF PREFERRED EMBODIMENTS

Figure 1:
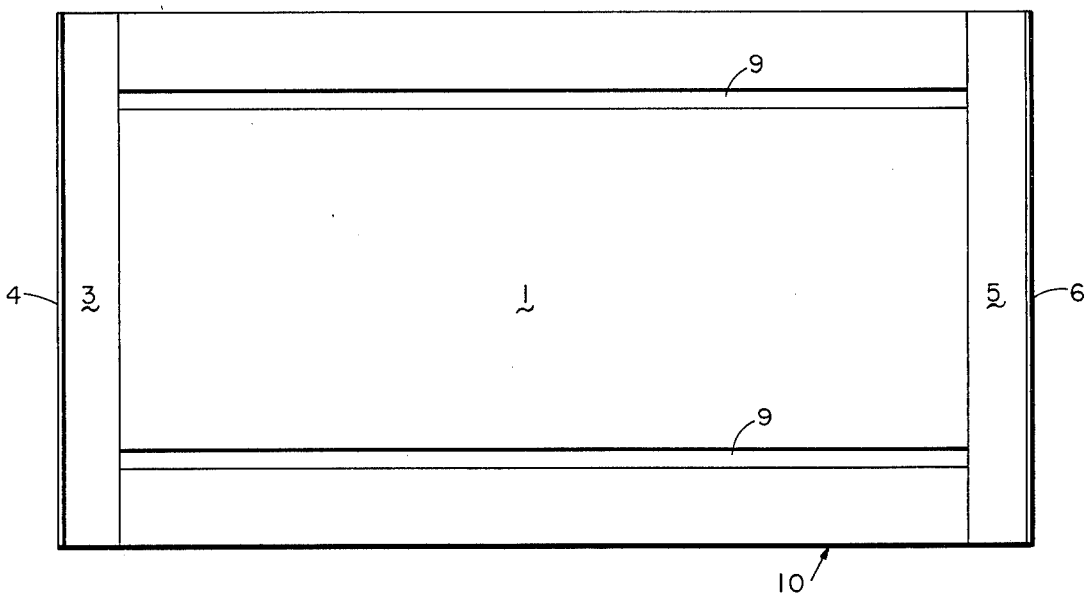
Figure 2:
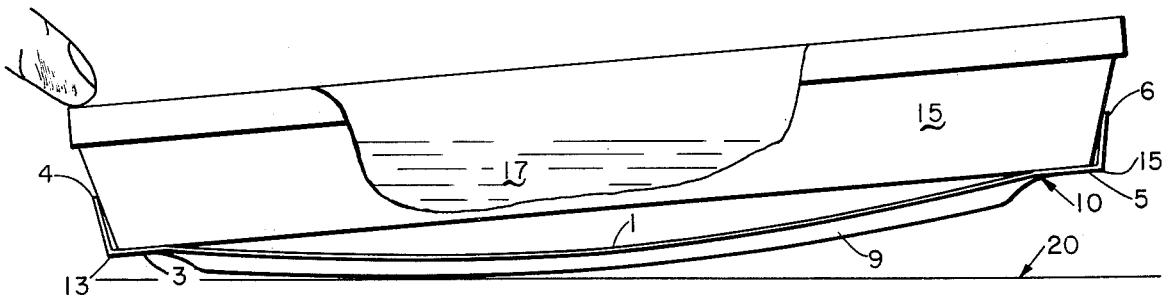

Referring now to FIGS. 1 and 2, wherein like reference numerals refer to like structures, the tray rocker of the invention comprises a one-piece, sheet-form structure 10 comprising a shallow U-shaped central portion 1 and tray support elements 3 and 5 extending substantially horizontally from each end of the U-shaped central portion 1. As can be seen most clearly in FIG. 2, it is the role of support elements 3 and 5 to, together, define a support platform upon which a tray 15 is received.

The U-shaped central portion 1 is desirably of sufficiently stiff construction as to not substantially yield under the weight of the tray 15 and its liquid contents 17. This may, of course, be accomplished simply by choice of a starting material of construction of suitably sufficient strength and thickness. However, in a preferred embodiment of the invention, substantial material and construction economies may be realized and the requisite stiffness generally provided by forming the rocker with one or more stiffening ribs 9 oriented longitudinally along the bow of the U-shaped central portion 1.

In another preferred embodiment of the invention, the tray support elements 3 and 5 will be provided with means to engage the tray 15, thereby to prevent accidental slippage of the tray. Suitable means to engage the tray 15 may conveniently take the form of upturned lips 4 and 6 integrally formed at the free end portions 13 and 15 of support elements 3 and 5, respectively.

In another preferred embodiment of the invention, means will be provided by which to limit the rocking motion of the rocker such that spillage of the liquid contents of a tray due to excessive rocking displacement thereof is minimized. This can be conveniently accomplished, as clearly shown in FIG. 2, by suitable selection of the widths of the support elements 3 and 5 and the radius of curvature of the U-shaped central portion 1 such that the free end portions 13 and 15 of elements 3 and 5 contact the general support surface 20 and thereby define the rocking limits of the device.

Suitable materials for construction of the tray rocker of the invention will be obvious to those skilled in the art and are generally uncritical. Accordingly, the tray rocker of the invention can generally be formed of a reinforced polymeric composition such as, for instance, polyamides, polyolefins, polyesters, epoxies ar ABS resins filled with fibrous or filamentous reinforcing agents such as asbestos, glass fiber or metal filaments or cloth. My tray rocker has been found, however, to be readily and economically formed from various sheet metal materials such as cold rolled steel, cooper, brass or aluminum and its alloys. Of the many sheet-form metals readily available commercially, I generally prefer those chosen from the class of stainless steels, particularly where exposure of the tray rocker to various chemicals is contemplated.

Where polymeric materials of construction are to be employed, exemplary suitable forming techniques can include, but are not limited to: vaccuum forming, hand lay-up, centrifual, matched-die and injection molding. Where metallic materials of construction are contemplated, the relatively simple geometry of the tray rocker befits it for economic forming thereof by hot or cold stamping or various of the known hydroforming metalworking processes.

Accordingly, while this invention has been described hereinbefore with respect to certain embodiments thereof, it is not so limited, and it should be understood that variations and modifications thereof may be made which are obvious to those skilled in the art without departing from the essential spirit or scope of the invention.

The embodiments of the invention in which an exclusive property or privilege is claimed are defined as follows:

1. A tray rocker comprising a one-piece structure formed from a sheet-form structural material, said structure comprising:

a shallow U-shaped central portion;

tray support elements extending substantially horizontally from the ends of said U-shaped central portion, said support elements together defining a support platform to an upturned lip member formed across each said tray support element, said lip members together defining means to engage a tray received by said support platform.

2. The tray rocker of claim 1 wherein said tray support elements extend outwardly from the ends of said U-shaped central portion and wherein said upturned lip members are formed across the free end portions of said tray support elements.

3. The tray rocker of claim 1 wherein said U-shaped central portion comprises at least one stiffening rib element formed substantially longitudinally thereon.

4. The tray rocker of claim 1 including means to limit rocking displacement thereof.

5. The tray rocker of claim 1 wherein said means to limit rocking displacement comprises the combination of the width of each said support element and the radius of curvature of said U-shaped central portion being such as to foster contact of the free end portions of said support elements with an essentially flat surface at the limits of rocking displacement of said tray rocker and to thereby define said free end portions as the rocking limit stops thereof.

6. The tray rocker of claim 1 formed of sheet metal.

7. The tray rocker of claim 6 formed of stainless steel.

8. The tray rocker of claim 6 formed by stamping.

9. The tray rocker of claim 6 formed by hydroforming.

* * * * *